US005555461A

United States Patent [19]

Ackerman

[11] Patent Number: 5,555,461

[45] Date of Patent: Sep. 10, 1996

[54] SELF CLEANING WIPER BLADE FOR CLEANING NOZZLE FACES OF INK JET PRINTHEADS

[75] Inventor: John C. Ackerman, Webster, N.Y.

[73] Assignee: Xerox Corporation, Stamford, Conn.

[21] Appl. No.: 176,925

[22] Filed: Jan. 3, 1994

[51] Int. Cl.[6] ..... B41J 2/165

[52] U.S. Cl. ..... 347/33; 347/36

[58] Field of Search ..... 347/22, 33, 44, 347/32, 36

[56] References Cited

U.S. PATENT DOCUMENTS

| | | | |
|---|---|---|---|
| 4,364,065 | 12/1982 | Yamamori et al. | 346/140 R |
| 4,638,337 | 1/1987 | Torpey et al. | 346/140 R |
| 4,679,059 | 7/1987 | Dagna | 346/140 R |
| 4,746,938 | 5/1988 | Yamamori et al. | 346/140 R |
| 4,849,774 | 7/1989 | Yokohama et al. | 346/140 R |
| 4,853,717 | 8/1989 | Harmon et al. | 346/140 R |
| 4,855,764 | 8/1989 | Humbs et al. | 346/140 R |
| 5,065,158 | 11/1991 | Nojima et al. | 346/140 R |
| 5,151,715 | 9/1992 | Ward et al. | 346/140 R |
| 5,182,582 | 1/1993 | Okamura | 346/140 |

FOREIGN PATENT DOCUMENTS

| | | | |
|---|---|---|---|
| 2101448 | 5/1987 | Japan | 347/33 |
| 101447 | 5/1987 | Japan | 347/33 |
| 18642 | 1/1989 | Japan | 347/44 |

*Primary Examiner*—Benjamin R. Fuller
*Assistant Examiner*—Germaine T. Wilson

[57] ABSTRACT

A self cleaning wiper blade cleaning system has at least one polyurethane wiping blade releasably mounted in a slot on a planar surface of a fixed structural member. A front end of the mounted blade wipes the nozzle face of the printhead as it enters and leaves a priming station to maintain the printhead nozzle face clear of ink and other debris. The ink which is removed from the printhead nozzle face by the edge of the wiper blade is drawn away therefrom by capillary action of small grooves cut in the wiper blade. The grooves have one end in contact with an absorbent pad provided at a bottom edge of the wiper blade and the other end of the slot is adjacent but spaced a predetermined distance from the front edge of the wiper blade. The capillary action of the grooves provide continuous removal of the ink from the vicinity of cleaning edge of the wiper blade, obviating the need of a separate system to clean the wiper blades. The grooves are so small that the beam strength and thus the cleaning force of the wiper blade is not significantly affected.

8 Claims, 4 Drawing Sheets

SELF CLEANING WIPER BLADE FOR CLEANING NOZZLE FACES OF INK JET PRINTHEADS

BACKGROUND OF THE INVENTION

The present invention relates to ink jet printing apparatus and is concerned with the printing apparatus maintenance system for a printhead in such apparatus. More particularly, this invention relates to cleaning of wiper blades used for cleaning the nozzle faces of ink jet printheads.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then refilled by capillary action, which in turn draws ink from a supply container. Operation of a thermal ink jet printer is described in, for example, U.S. Pat. No. 4,849,774.

One particular form of thermal ink jet printer is described in U.S. Pat. No 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. Nos. 4,855,764; 4,853,717 and 4,746,938 while the removal of gas from the ink reservoir of a printhead during printing is described in U.S. Pat. No. 4,679,059.

It has been found that the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress and, like the ink residue, can also have a deleterious effect on print quality. It has previously been proposed, in U.S. Pat. No. 4,853,717, that a printhead should be moved across a wiper blade at the end of a printing operation so that paper dust and other contaminants are scraped off the orifice plate before the printhead is capped. It has also been proposed, in U.S. Pat. No. 4,746,938, that an ink jet printer should be provided with a washing unit which, at the end of a printing operation, directs water at the face of the printhead to clean the latter before it is capped.

U.S. Pat. No. 5,151,715 to Ward et al. discloses a printhead wiper for ink jet printers molded from an elastomer and including a wiping beam having a wiping edge formed at one end of the beam. The other end of the beam is integral with a base. A hole through the beam near the base decreases beam stiffness. A higher durometer elastomer may thus be used without applying excessive wiping force to the printhead. In another embodiment, the wiper includes a pair of wiping blades each of which have wiping edges for wiping a printhead traveling thereby. The first wipe removes pooled ink and debris and spread viscous ink while the second wipe furthers the spread of ink before it can retract to its former drop or pooled configuration.

U.S. Pat. No. 4,364,065 to Yamamori et al. discloses a nozzle moistening device to prevent clogging of the nozzle of an ink jet writing head, which includes an elastic enclosure fluid-tightly engageable with the front face of the writing head when not in use, a source of water, and a capillary tube for transmitting water from the source to the enclosure by capillary action to permit evaporation of water in the enclosure to moisten the nozzle. FIG. 6 therein discloses a multi-bladed wiping device.

U.S. Pat. No. 5,065,158 to Nojima et ai. discloses a cleaning member positioned to bear against the discharge port forming surface of an ink jet recording head, which contains the discharge ports therein, to thereby clean the discharge port forming surface. The cleaning member is formed of a material composed chiefly of hydrogenated nitrile butadiene rubber.

Copending U.S. Ser. No. 07/974,765, filed on Nov. 12, 1992 and entitled "Wiper Blade Cleaning System for Non-Coplanar Nozzle Faces of Ink Jet Printheads" by inventor Karai P. Premnath and assigned to the same assignee as the present invention, U.S. Pat. No. 5,396,271, discloses a wiper blade cleaning system which has two polyurethane wiping blades of unequal lengths, but which are otherwise identical. The blades are releasably mounted in slots on a planer surface of a fixed structural member. The mounted blades are parallel and spaced apart a predetermined distance. The positioning of the blades is dependent on the order in which they must act on the nozzle face of the printhead as it leaves the priming station, so that the shorter blade cleans first. The shorter blade is stiffer because of its shorter length and serves to remove ink efficiently off of the printhead nozzle face. The longer blade is more compliant because of its added length and follows in the wake of the shorter blade to remove the last vestige of ink left by the stiffer, shorter blade.

SUMMARY OF THE INVENTION

It is an object of the present invention to provide an effective blade cleaning device for cleaning ink jet printheads having blades which are self cleaning.

It is another object of the invention to use small grooves in the wiper blades of the blade cleaning device in order to draw ink away from the vicinity of the cleaning edge of the wiper blades by capillary action and enable the continuous removal of the ink by providing an absorbent pad at the bottom of the wiper blade grooves.

In the present invention, at lease one and preferably two polyurethane wiping blades of unequal lengths, but otherwise identical, are releasably mounted in slots on a planar surface of a fixed structural member. The mounted blades are parallel and spaced apart a predetermined distance. The positioning of the blades is dependent on the order in which they must act on the nozzle face of the printhead as it leaves the priming station, so that the shorter blade cleans first. The shorter blade is stiffer because of its shorter length and serves to remove ink efficiently off of the printhead nozzle face. The longer blade is more compliant because of its added length and follows in the wake of the shorter blade to remove the last vestige of ink left by the stiffer, shorter blade. Each blade has opposing planar surfaces with a plurality of relatively small grooves therein and opposing end edges, one edge of which cleans the printhead nozzle face. The grooves, through capillary action, draws the ink which accumulates on the wiper blade cleaning edge and moves the ink into an absorbent pad in contact with the grooves at the edge of the blade opposite the one used to clean the nozzle face. This arrangement provides for continuous removal of ink from the cleaning edge of the blade, thus obviating the need for a separate system to clean the wiper blades.

The foregoing and other objects, features, and advantages of the invention will become more readily apparent from the following detailed description of a preferred embodiment wherein like index numerals indicate like parts.

DESCRIPTION OF THE PREFERRED EMBODIMENT

Figure 1:
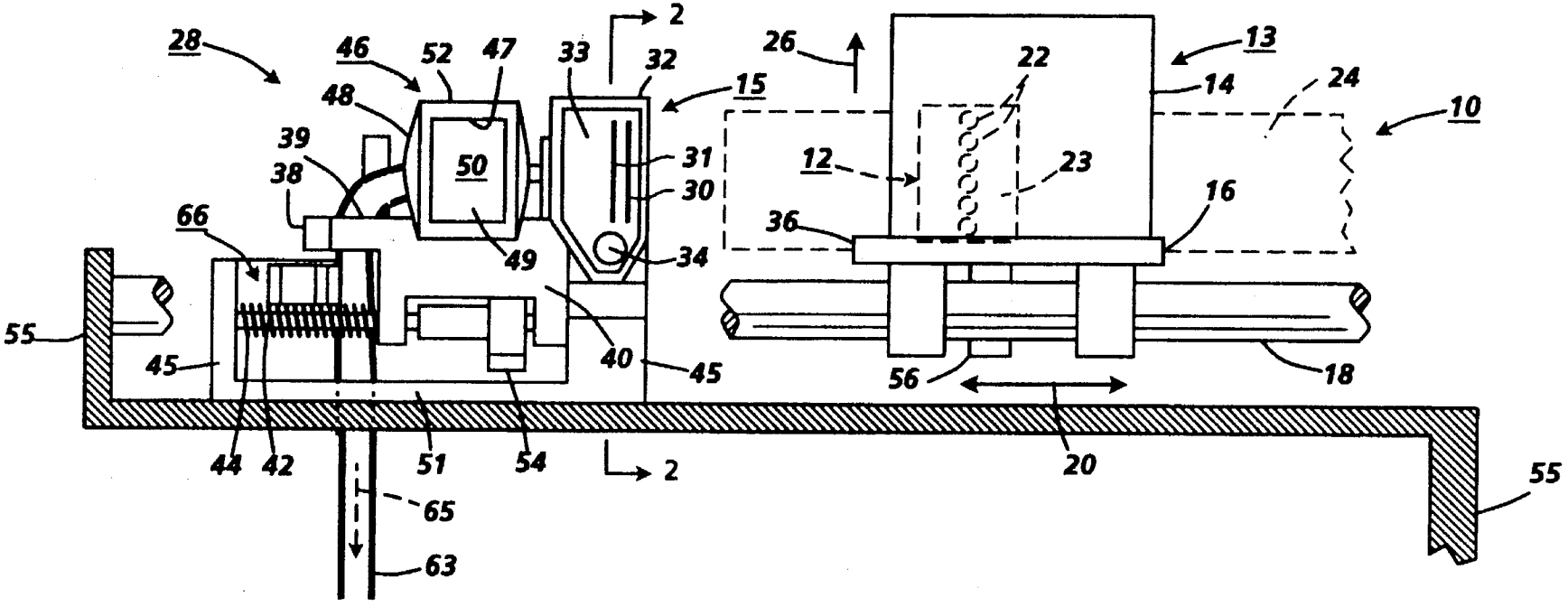
FIG. 1 is a schematic front elevation view of a partially shown ink jet printer having a maintenance station incorporating the cleaning blade assembly of the present invention.

The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside the printing zone, is a maintenance station 28. At the end of a printing operation or termination of the printing mode by the printer 10, the carriage 16 is first moved past the wiper blade cleaning assembly 15 of the present invention comprising at least one and preferably two releasably mounted wiper blades 30, 31 in a fixed structural member 32, more fully discussed later, so that the printhead nozzle face 23 is wiped free of ink and debris every time the printhead and cartridge (hereinafter print cartridge 13) enters or exits the maintenance station. Adjacent the wiper blades in the direction away from the printing zone and at a predetermined location along the translating path of the print cartridge is a collection surface 33 in the fixedly mounted structural member 32. The carriage will position the print cartridge at this collection surface, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the wiper blade assembly, cleaning the nozzle face, and to the predetermined location confronting the collection surface 33, whereat the printer controller causes the printhead to eject a number of ink droplets per nozzle therein. In the preferred embodiment, the printhead will eject about 25 ink droplets per nozzle onto the collection surface.

Since the collection surface is located within the structural member 32 and adjacent the wiper blades 30, 31, both the ink ejected onto the collection surface or ink accumulated on the blades may run or drip off the blades and be collected on the collection surface which is substantially parallel to the printhead nozzle face and oriented in a direction so that the force of gravity causes the ink on the collection surface to drain into the lower portion thereof, where an opening 34 is located for the ink to drain therethrough into a pad of absorbent material 41 (shown in FIG. 2) behind the collection surface 33 of the structural member 32. Some of the ink removed from the printhead nozzle face remains on the blades and, if not removed by, for example, the prior art means of rubbing the blade cleaning edges on an absorbent cleaning pad, will be painted back on the nozzle face the next time the nozzle face is cleaned by the blades. In this invention, relatively small grooves formed in the surfaces of the blades remove the residual ink that tends to accumulate by capillary action, as described later, and thereby transport the residual ink to the absorbent pad 41, thus eliminating the need of a means to clean the blades.

When the carriage 16 continues along guide rails 18 beyond the structural member with the wiper blades for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and print cartridge mounted thereon. The cap carriage is biased towards the structural member 32 by spring 44 which surrounds guide rail 42. The cap 46 has a closed wall 47 extending from a bottom portion 48 of the cap to provide an internal recess 49 having a piece of absorbent material 50 therein. The top edge of the wall 47 is covered by a resilient material to form a seal 52. The cap is adapted for movement from a location spaced from the plane containing the printhead nozzle face to a location wherein the cap seal intercepts the plane containing the printhead nozzle in response to movement by the cap carriage. After the carriage actuator edge 36 contacts the catch 38, the print cartridge carriage and cap carriage move in unison to a location where the cap is sealed against the printhead nozzle face. At this location, the cap closed wall surrounds the printhead nozzles and the cap seal tightly seals the cap recess around the nozzles. During this positioning the cap against the printhead nozzle face, the cap carriage is automatically locked to the print cartridge by pawl 54 in cooperation with pawl lock edge 56 on the carriage 16. This lock by the pawl together with the actuator edge 36 in contact with catch 38 prevents relative movement between the cap 46 and the printhead nozzle face 23.

Once the printhead nozzle face is capped and the cap is locked to the print cartridge, the printer controller may optionally cause the printhead to eject a predetermined number of ink droplets into the cap recess 49 and absorbent material 50 therein for the purpose of increasing humidity in the sealed space of the cap recess.

A typical diaphragm vacuum pump (not shown) is mounted on the printer frame 55 and is operated by any known drive means. The vacuum pump is connected to the cap 46 by flexible hose 63.

The cap carriage guide rail 42 is fixedly positioned between fixed upstanding support members 43, 45 which extend from base 51 removably attached to the printer frame 55. Base 51 has an elongated slot (not shown) for passage of the flexible hose 63 and to accommodate movement therein. A pinch valve 66 is rotatably attached to the cap carriage 40, so that movement of the cap carriage toward upstanding support member 45 pinch the flexible tube 63 closed.

Thus, at one predetermined location along guide rails 18, the print cartridge 13, through engagement of the carriage actuator edge 36 and catch 38 of the cap carriage, will cause the printhead nozzle face to be capped, but the tube 63 will not be pinched shut. This will be referred to as the capped position, and the nozzle face is subjected to humidified, ambient pressure air.

When it is necessary to prime the printhead, the carriage 16 is moved from the capped position towards fixed support member 45 until pinch valve 66 contacts support member 45 causing the pinch valve to rotate against flexible hose 63 and pinches it closed, i.e., pinch valve 66 is caused to close flexible hose 63 by movement of the carriage 16. When the carriage is returned to the location where the nozzle face is capped, but the flexible hose 63 is no longer pinched closed; i.e., in the capped position, the sealed cap internal recess is subjected to a negative pressure of minus 120 inches of $H_2O$ from a source of negative pressure (not shown). The print cartridge remains at this position for about one second to achieve a specific relationship of pressure in the cap and flow impedance of the ink through the nozzles and the maintenance system air volume in order to yield a priming target of 0.2 cc±0.05 cc of ink. The negative pressure begins to drop slightly due to the flow of ink. After about one second, the carriage 16 then moves, breaking the cap seal and stopping the priming. The cap pressure drops and returns to ambient. The print cartridge is moved past the wiper blades 30, 31 to a hold position adjacent the wiper blade assembly 15 at a location between the wiper blade assembly and the printing zone for a predetermined time period to wait while the ink and air are sucked or purged from the cap. When this has been accomplished, the carriage returns the print cartridge to the capped position to await for a printing mode command from the printer controller.

Figure 2:
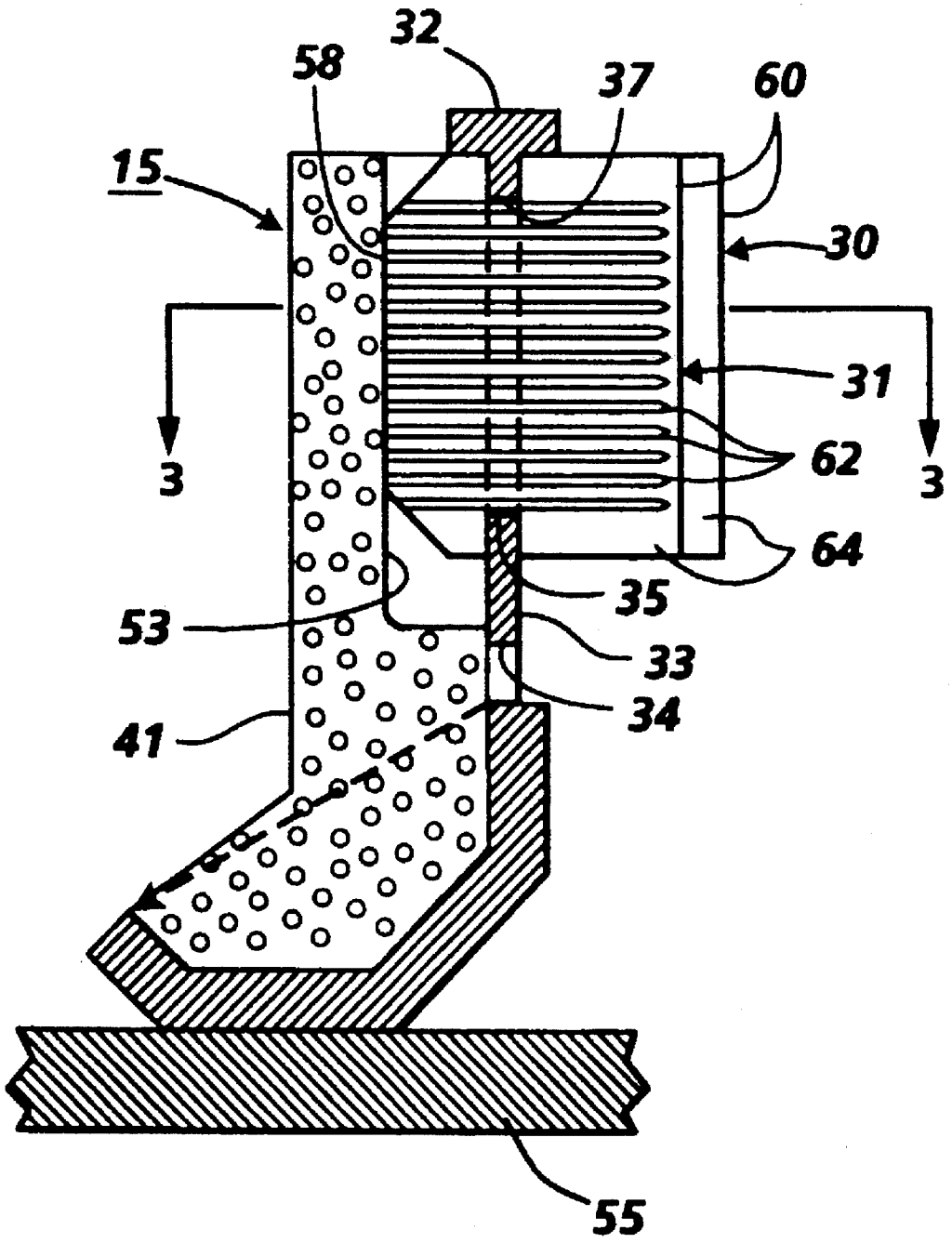
FIG. 2 is a cross-sectional view of the cleaning blade assembly as viewed along section line 2—2 of FIG. 1.
Figure 4:
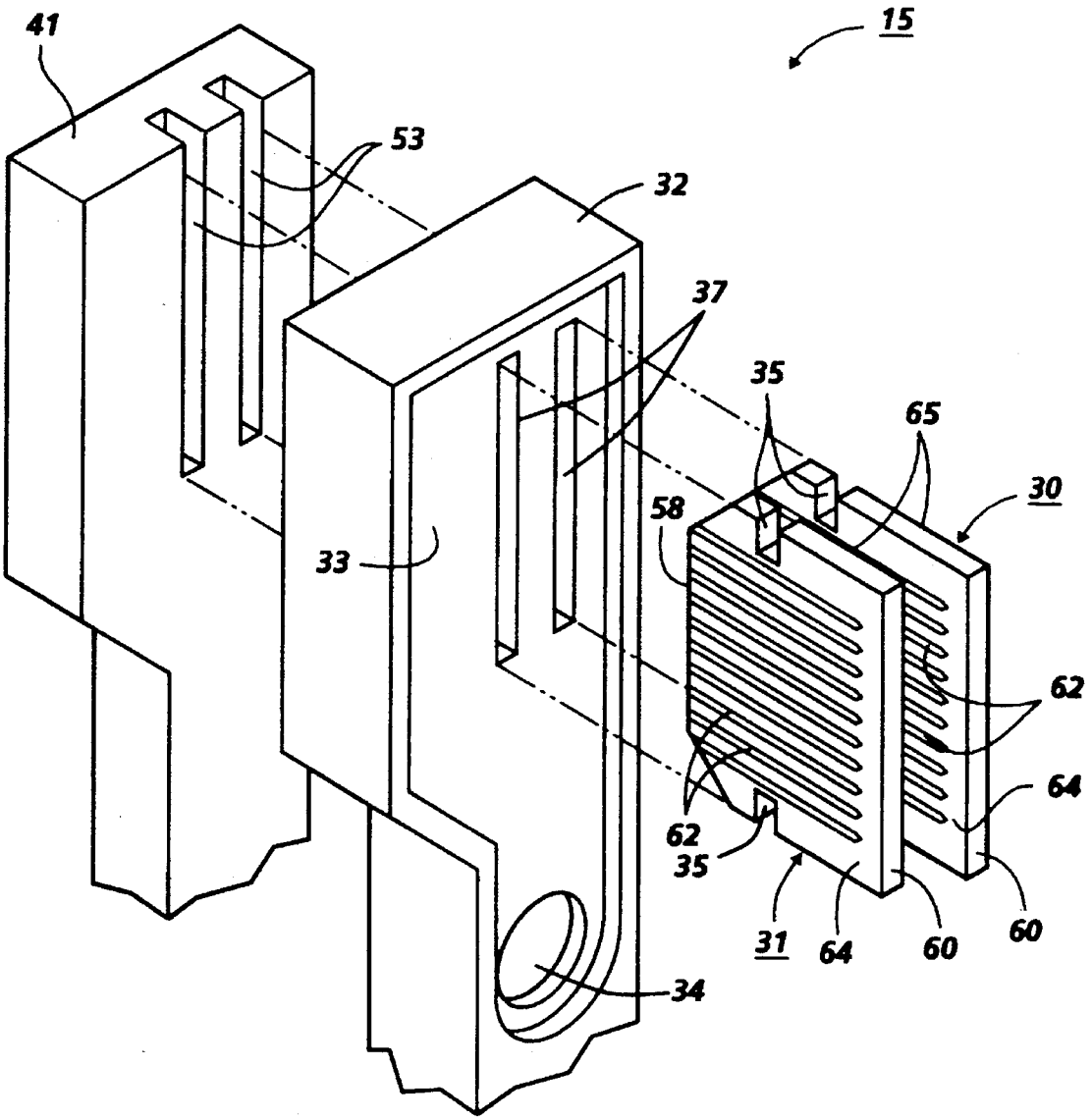
FIG. 4 is a partially shown, enlarged, isometric, exploded-view of the cleaning blade assembly.

FIG. 2 is a cross-sectional elevation view as viewed along section line 2—2 in FIG. 1, showing the wiper blades 30, 31 releasably mounted in slots 37 in the blade holding structural member 32. FIG. 4 is a partially shown, isometric exploded view of the structural member 32, blades 30, 31, and preformed absorbent pad 41. Notches 35 in the sides of the blades are used to releasably lock the blades into the structural member slots 37. The preformed or shaped absorbent pad 41 has elongated recesses 53 which fit around and surround the back edge 58 of blades 30, 31 when they are installed in the structural member slots 37. The blades are identical except that the distance between the skived front edge 60 of blade 30 and the back edge 58 is longer than this distance for blade 3 t. Each surface 64, 65 of the blades are flat and parallel with each other and have a plurality of parallel grooves 62 therein. The grooves are spaced from the front cleaning edge 60 by about 1 to 2 mils, and extend through the back edge 58. The grooves may be formed by any known means, such as, for example, dicing, etching, or integrally molded therein when the blades are fabricated. When the blades are installed in the structural member 32, so that the shorter blade 31 cleans or wipes the printhead nozzle face 23 first, the preformed absorbent pad 41 is installed into the structural member 32 with the blade edges 58 of the blades residing in the absorbent pad recesses 53. The blade grooves 62 have a cross-sectional area sufficiently small to provide a capillary action on any ink which enters the grooves and thereby transports the ink to the absorbent pad 41. In the preferred embodiment the cross-sectional area of the grooves is about 10 to 20 square mils.

Thus, any ink which accumulates on the wiper blades 30, 31 is removed from the cleaning edge 60 thereof by means of the small grooves 62 cut or formed into the wiper blade surfaces 64, 65. These grooves, through capillary action, draw the ink away from the edge 60 of the wiper blade and transport the ink to the absorbent pad 41. The absorbent pad has recesses 53 into which the bottom edges 58 of the wiper blades reside, so that the absorbent pad surrounds and contacts the grooves in that portion of the blade from the notches 37 to the blade edge 58. This configuration provides for continuous removal of the ink from the cleaning edge 60. Because the grooves 62 are so small, their presence in the wiper blades 30, 31 do not significantly affect the beam strength thereof and thus do not affect the cleaning efficiency of the wiper blades.

Figure 3:
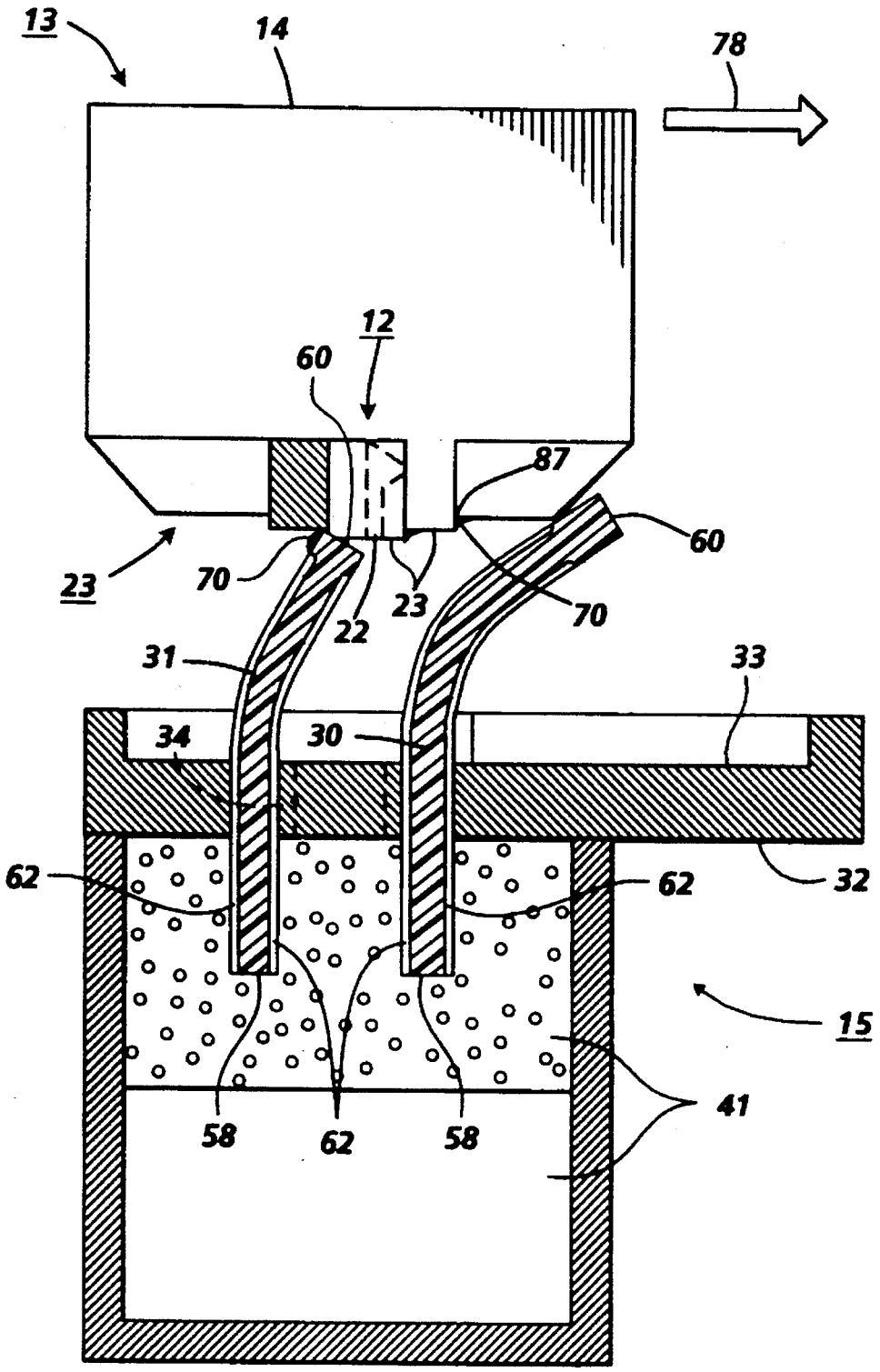
FIG. 3 is a schematic plan view showing the printhead nozzle face being cleaned by the cleaning blade assembly, and the wiper blades thereof being cleaned by capillary action of the grooves in each surface of the blades.

Referring to FIGS. 1 and 3, after a print cartridge 13 has undergone a prime operation, the print cartridge disengages from the cap 46 and proceeds towards a position in the direction of arrow 78 intermediate between the capped position and the wiper blade assembly 15 where it resides for a few seconds. This waiting period enables much of the ink residing near the nozzles to be retracted back into the printhead due to the capillary and other negative pressure forces present in the nozzles 22 and the cartridge 14. The print cartridge next proceeds toward the wiper blade assembly 15, whereat the shorter blade 31 precedes the longer blade 30 in its cleaning action. The stiffer, shorter blade serves to remove ink efficiently off the front surface of the printhead face 23 and most of the ink off the other components making up the nozzle face as well. However, due to its stiffness, and because the surface topography of the printer cartridge nozzle face is characterized by discontinuities, the shorter blade can chatter and small amounts of ink 70 may be deposited in pockets 87. In this invention, the longer, complaint wiper blade 30 that follows in the wake of the shorter blade 31 removes the last vestige of ink remaining on the nozzle face. Thus, the two blades 30, 31 complement one another. The shorter, more efficient, stiffer blade succeeds in removing the lion's share of the ink off the front face of the cartridge, but it can leave some ink behind. The longer, less stiff blade has limited ink removal capability, but it is superior in handling non-coplanar surfaces and removes the ink that is left behind by the shorter blade through is conformability about surface discontinuities or irregularities. Any ink removed by the wiper blades is transported by capillary action along the grooves 62 to the absorbent pad 41.

In the preferred embodiment, spacing between the wiper blades 30, 31 is about 3 mm, and the respective heights of the shorter and longer wiper blades 31, 30 from the collection surfaces 33 of the structural member 32 (or blade notches 35) to the cleaning edges 60 are 5.0±0.25 mm and 5.5±0.25 mm, respectively.

The blades in the preferred embodiment were empirically optimized from a sheet of polyurethane ester type material having a 70±5 shore A durometer and a thickness of 1.05±0.1 mm. The cleaning edges 60 are skived to have very short radii (not shown), and the grooves 62 are diced into the blade surfaces 64, 65. The blades have a width along the cleaning edge 60 of about 18.4 mm. The slots 37 in the structural member 32 are parallel and have the spacing between them of about 3 mm. Once the blades are forced into the slots, so that the notches 35 of the blades lock therein, the blades are tightly but releasably held in place. The depth of the notches is equal to the blade width minus the distance between notches divided by two, which in the preferred embodiment is 1.2 mm.

Ink which drips from the blades and ink droplets ejected against the planar collection surface 33 of structural member 32 are pulled under the influence of the force of gravity towards the lower portion of the structural member where opening 34 (also refer to FIG. 4) directs the ink to an absorbent material 41 held in a recess at the back portion of the structural member.

Many modifications and variations are apparent from the foregoing description of the invention, and all such modifications and variations are intended to be within the scope of the present invention.

I claim:

1. A fixed wiper blade assembly located in a maintenance station for an ink jet printer having a printhead with nozzles in a nozzle face mounted on a translatable carriage for concurrent reciprocal movement therewith, the wiper blade assembly being positioned for cleaning ink and other debris from the printhead nozzle face when the carriage moves the printhead thereby, the wiper blade assembly comprising: at least one planar wiping blade, having opposed planar surfaces and two opposing ends, one of the two opposing ends being releasably mounted on and perpendicular to a fixed structural member, the mounted one of the ends of the blade being in contact with an ink absorbent material, the other of the opposing ends of the blade having parallel edges for cleaning the printhead nozzle face, each of the blade planar surfaces having a plurality of relatively small, parallel grooves formed therein, the grooves having one end adjacent but spaced from said other end of the blade with the parallel edges for cleaning and another end of the grooves extending to the mounted end and into contact with the absorbent material, each of said grooves providing a capillary force to ink in contact therewith, so that a continuous removal of the ink is provided from a vicinity of the wiping blade which contacts the printhead nozzle face to the absorbent material, thereby obviating a need for a separate cleaning system for the blade.

2. The wiper blade assembly of claim 1, wherein the at least one wiping blade is made from an elastomeric material and has a predetermined thickness; and wherein the relatively small grooves have a U-shaped cross-section.

3. The wiper blade assembly of claim 2, wherein the wiper blade assembly further comprises a another wiper identical to said at least one planar wiping blade, except that the distance between the two opposing ends thereof are longer, the wiping blades being releasably mounted on the fixed structural member parallel with each other and a predetermined distance apart.

4. The wiper blade assembly of claim 3, wherein the wiping blades have parallel opposing sides with identical opposing notches in identical locations therein; and wherein the structural member has two identical parallel elongated slots with identical lengths equal to the distance between the notches in the wiping blades for releasably receiving and holding the wiper blades therein.

5. The wiper blade assembly of claim 4, wherein the wiping blades are substantially normal to structural member; and wherein the notches in the blades have a predetermined width.

6. The wiper blade assembly of claim 5, wherein the shorter blade is first to contact and clean the printhead nozzle after the printhead has been primed.

7. The wiper blade assembly of claim 6, wherein the structural member has a front surface and a back surface, and the absorbent material is located on the back surface of the structural member.

8. The wiper blade assembly of claim 7, wherein the grooves have a cross-sectional area of about 100 to 400 square micrometers, and wherein the absorbent material is surroundingly positioned around the wiping blade extending through the fixed structural member to attract by capillary action and to absorb the ink in the grooves.

* * * * *